United States Patent [19]

Thorneburg

[11] 4,255,949

[45] Mar. 17, 1981

[54] ATHLETIC SOCKS WITH INTEGRALLY KNIT ARCH CUSHION

[76] Inventor: James L. Thorneburg, P.O. Box 5440, Statesville, N.C. 28677

[21] Appl. No.: 66,914

[22] Filed: Aug. 16, 1979

[51] Int. Cl.[3] ..... A41B 11/02; D04B 9/46

[52] U.S. Cl. ..... 66/185; 2/239

[58] Field of Search ..... 66/178 R, 182, 183, 66/184, 185, 186, 187, 194, 196; 128/166, 166.5; 2/239; 36/9, 10

[56] References Cited

U.S. PATENT DOCUMENTS

| | | | |
|---|---|---|---|
| 1,659,171 | 2/1928 | Spafford | 128/166.5 |
| 2,075,610 | 3/1937 | Hemingway | 66/182 |
| 2,102,368 | 12/1937 | Martez | 66/185 X |
| 2,144,563 | 1/1939 | Davis | 66/185 |
| 2,219,235 | 10/1940 | Morton | 66/185 X |
| 3,274,804 | 9/1966 | Thorneburg et al. | 66/171 |
| 3,793,851 | 2/1974 | Thorneburg | 66/185 |
| 3,990,115 | 11/1976 | Nester | 66/172 E |
| 4,104,892 | 8/1978 | Thorneburg | 66/185 |

*Primary Examiner*—Ronald Feldbaum

*Attorney, Agent, or Firm*—Bell, Seltzer, Park & Gibson

[57] ABSTRACT

The present athletic socks are particularly suitable for jogging and running and are provided with shock absorber cushion pads (C) in the inner portions (16*a*, 36*a*) of the arch areas (16, 36) and being formed by a sufficiently greater amount of yarn being knit in the inner arch portions (16*a*, 36*a*) than the amount of yarn knit in the outer portions of the arch (16*b*). The shock absorber cushion pads (C) protect and cushion the inner portions of the arches of the wearer's feet and reduce the shock normally imparted to the inner portions of the arches of the feet of the wearer so that normal articulation of the bones in the feet takes place when the wearer is jogging and running. The shock absorber cushion pads (C) are illustrated as being formed by providing a greater density of terry loops in the inner portions of the arch area (16*a*, 36*a*) of the socks than in the outer portions of the arch (16*b*) to enhance the cushioning provided in the inner portions of the arch (16*a*, 36*a*) of each sock.

7 Claims, 15 Drawing Figures

ATHLETIC SOCKS WITH INTEGRALLY KNIT ARCH CUSHION

FIELD OF THE INVENTION

This invention relates generally to athletic socks particularly suitable for jogging and running and more particularly to the provision of an integrally knit shock absorber cushion in the inner portion of the arch area of each sock of a pair of such socks so that the socks are "right" and "left" and adapted to fit the corresponding feet of the wearer. The inner arch portion of each sock is knit with a sufficiently greater amount of yarn than the amount of yarn knit in the outer arch portion for enhancing the support and cushioning provided to the inner portion of each arch of the wearer's feet.

BACKGROUND OF THE INVENTION

It has been the practice for many years to provide athletic type socks with a terry loop "cushion" sole in which the same type and density of terry loops extend throughout the length of the lower sole portion of the sock to provide the same type of terry loop cushioning, protection and moisture absorbency throughout the entire length of the lower portion of the foot of the wearer. When taking part in athletic activities, such as jogging and running, the cartilages joining the bones in the arch of the foot provide elasticity and the arch tends to flatten each time the foot impacts on the surface. When the known type of sock with the same type of terry loop cushioning throughout the length of the sole is worn by a person having either a flatter or higher arch than normal and with a shoe provided with a normal arch support, the flattening of the arch results in the flatter than normal arch receiving a major portion of the shock of the impact, while the higher than normal arch is not properly supported. In either case, the arches of the feet begin to hurt after only a short period of jogging or running.

It is known to provide the same type of terry loop cushioning in certain selected areas of the foot of a sock, for example in the manner illustrated in the Davis U.S. Pat. No. 2,144,563. However, this patent discloses providing the same type of terry loops throughout the arch and ball areas and does not solve the problems encountered by joggers and runners with flatter or higher than normal arches.

Others have recognized the need for supporting and applying a cushion pad beneath the arch and various types of arch supports have been incorporated in shoes. Also, it has been suggested that arch support pads be provided in pockets in socks, of the type disclosed in U.S. Pat. No. 2,790,975. U.S. Pat. No. 2,219,235 discloses forming an elastic band extending completely around or beneath the middle of the foot of a sock and making the lower half of the band of thicker material. This arrangement supports the entire lower half of the arch area of the foot so that the support on both the inner and outer portions of the arch is the same and the support on the inner portion is not effective.

SUMMARY OF THE INVENTION

With the foregoing in mind, it is an object of the present invention to provide athletic socks particularly suitable for jogging and running with an integrally knit terry loop shock absorber cushion in the inner portions of the arch areas of each sock for cushioning and supporting the arches of the wearer's feet and with a lesser amount of cushioning or terry loop density in the adjacent outer portions of the arch areas so that the greater amount of terry loop density in the inner arch portion area provides cushioning and support for the corresponding inner portions of the arches of the wearer's feet.

The cushioning in the inner arch of the socks of the present invention eliminates the need for separate arch pads because the shock absorber cushion is knit as an integral part of the inner portion of the arch area of each sock. The cushioning in the inner arch areas of the present socks provides particular advantages when worn with athletic shoes having arch supports which fail to provide sufficient support and cushioning to prevent discomfort of the wearer's arch during participation in vigorous athletic activities, such as running and jogging. It is necessary to provide cushioning and support of the bones of the feet in the normal and correct position so that relief is provided from discomfort incident to strains and pressures on the bones, ligaments, tissues, nerves and the cartilages joining the arch bones. The present shock absorber cushions in the inner portions of the arch areas of each sock are positioned to absorb, diffuse and reduce the shock and jar normally applied by a jogger or runner to the arch bones located in the arch areas of the feet. By relieving the shock normally applied in the arch areas, the shock, strain and pressure normally transmitted to the remaining bones of the feet are also reduced so that normal articulation of the bones in the feet takes place when jogging or running.

In one embodiment of the socks of the present invention, the inner portion of the arch area of each sock is provided with terry loops knit of two terry yarns to provide a relatively heavy or dense cushion of greater terry loop density in the inner portion of the arch area while a single terry yarn forms terry loops in the adjacent outer portion of the arch area so that the outer arch portion includes lesser terry loop density to provide cushioning and support for the corresponding inner arch areas of the wearer's feet.

In another embodiment of the socks of the present invention, the inner portion of the arch area of each sock is provided with terry loops knit of a single terry yarn and the adjacent outer portion of the arch area is devoid of terry loops to reduce the weight of the socks and to provide cushioning and support for the corresponding inner arch areas of the wearer's feet.

The jogging and running socks of the present invention may be of the low-cut type, may be of a medium height with a cuff extending to the ankle, or may be provided with a longer leg so that the cuff is positioned below or above the knee. The socks may be manufactured in these different styles for wear in different seasons of the year. Also, the prospective buyer is provided with several styles from which to choose, depending upon the particular preference of the buyer.

The provision of a greater terry loop density in the inner portion of the arch area with a lesser terry loop density in the adjacent outer portion of the arch area insures that the full benefit of the terry loop shock absorber cushion in the inner portion of the arch area is available to be applied to the arches of the feet of the wearer. This type of shock absorbing cushioning is more effective than that provided in the presently available type of athletic socks in which the entire arch area includes the same type of terry loop cushioning in both the inner and outer arch portions. With the same density of terry loops extending throughout the arch area, the cushioned arch area supports and cushions both the inner and outer portions of the arch to the same degree so that the inner portion of the arch does not receive the full benefit of the cushioning. On the other hand, the reduction, or elimination, of the terry loops in the outer portion of the arch area of each sock, in accordance with the present invention, provides greater terry loop density in the inner portion of the arch of each sock so that the support and cushioning in the arch area is enhanced and the full benefit of the shock absorber cushions of greater terry loop density is provided in the inner portion of the arch of the wearer's feet.

BRIEF DESCRIPTION OF THE DRAWINGS

Other objects and advantages will appear as the description proceeds when taken in connection with the accompanying drawings, in which.

DESCRIPTION OF THE EMBODIMENT ILLUSTRATED IN FIGS. 1–10

Figure 1:
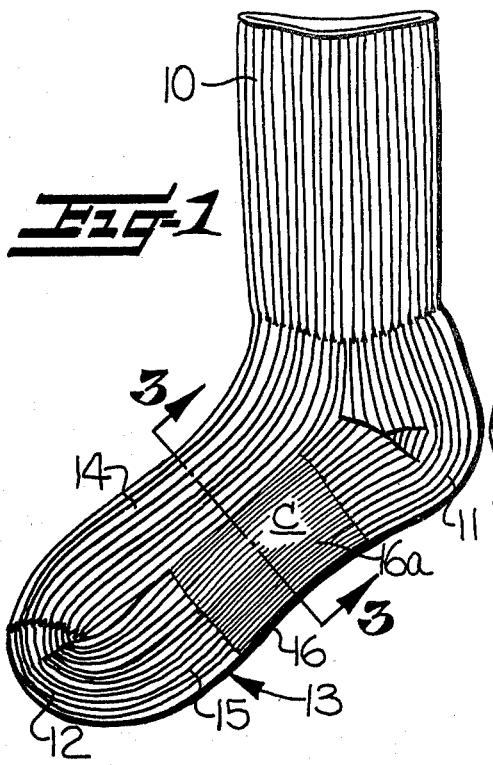
FIG. 1 is a side elevational view of one sock of one embodiment of the socks of the present invention, the sock being shown in flattened condition and being adapted to be worn on the right foot.
Figure 2:
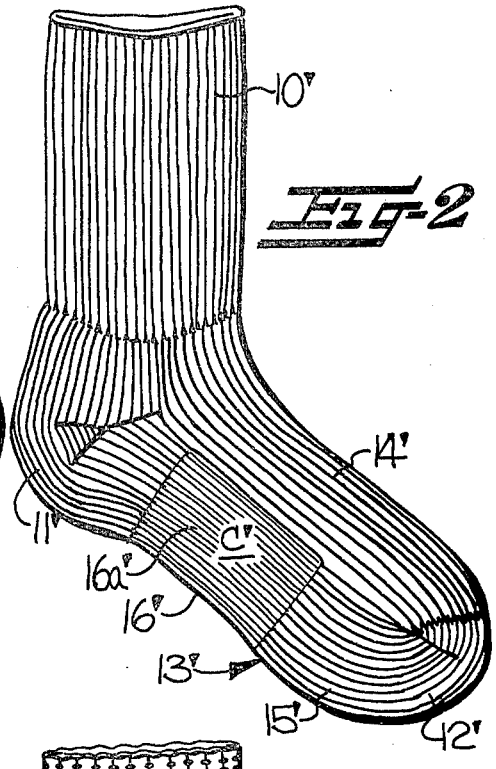
FIG. 2 is a view similar to FIG. 1 but illustrating a sock adapted to be worn on the left foot.

The socks illustrated in FIGS. 1–10 are of the type generally referred to as ankle length socks. The respective "right" and "left" socks of FIGS. 1 and 2 are the same except that the arch cushioning pads are integrally knit on opposite sides of halves of the arch. The sock of FIG. 1 will be described and the corresponding parts of the sock of FIG. 2 will bear the same reference characters with the prime notation added.

Generally, the sock (FIG. 1) includes a mock rib upper cuff 10 which is formed by knitting a body yarn while inlaying an elastic yarn in the usual manner. The foot of the sock includes a reciprocatorily knit heel area or pocket 11 provided with terry loops, formed in a manner to be presently described. The foot of the sock also includes a reciprocatorily knit toe portion or pocket 12, an integrally knit lower sole, broadly indicated at 13, which connects the heel pocket 11 and the toe pocket 12, and an upper instep 14. The sole 13 encompasses substantially one-half the lower circumference of the foot and the instep 14 encompasses substantially one-half the circumference of the upper portion of the foot (FIG. 3).

The sole 13 includes a ball terry area 15 positioned adjacent to the toe pocket 12 and extending toward the heel pocket 11. The rear of the ball area 15 is integrally knit with the forward end of an arch terry are 16 extending throughout the sole 13 and from one side to the other of the instep 14. The arch terry area 16 is divided along the middle wale of the sole 13 to define an inner arch portion **16*a* and an outer arch portion 16*b* (FIG. 3). The inner and outer arch portions 16*a*, 16*b* are positioned on opposite sides of the sole 13 and extend coursewise from substantially the middle wale of the sole 13. The arch area 16 extends to a position closely adjacent the heel pocket 11**.

Figure 3:
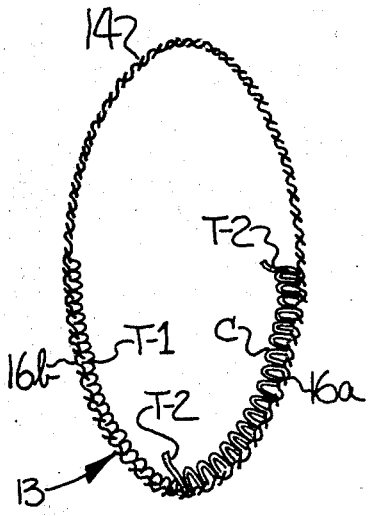
FIG. 3 is a schematic vertical sectional view taken along the line 3—3 in FIG. 1 and with the sock in partially opened condition.
Figure 6:
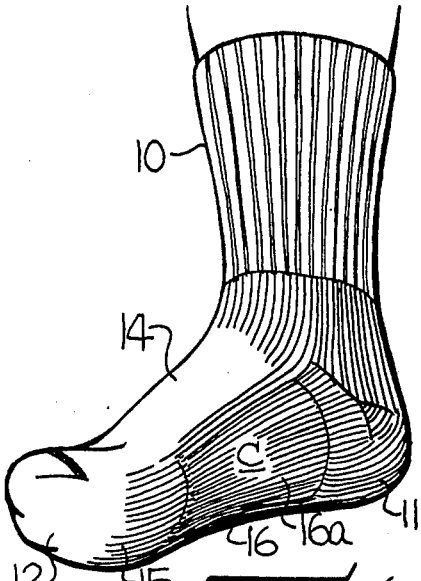
FIG. 6 is a perspective view of the sock of FIG. 1, positioned on the foot and looking upwardly from beneath the foot.

As best shown in FIG. 3, the inner portion **16*a* of the arch 16 is provided with a relatively greater density of terry loops to form an arch shock absorber cushion pad, indicated at C. The arch support cushion pad C is adapted to extend from about the middle of the bottom of the foot and up the side of the sole of the sock to cushion and protect the inner portion of the arch of the foot of the wearer (FIG. 6**).

The sock is knit throughout of one or more suitable body yarns, indicated in FIGS. 7–10 as a single plain yarn B. A first terry yarn, indicated at T-1 and speckled for identification, is knit with the body yarn B and forms a first set of terry loops throughout the heel 11, toe 12 and ball 15. The successive courses of the knit fabric of FIGS. 7 and 9 extend in a vertical direction and the needle wales, indicated at W-1, W-2 and W-3, extend in a horizontal direction with the sinker wales, in which the terry loops are formed, aligned between the needle wales.

The first terry yarn T-1 is knit in plated relationship with the body yarn B in the needle wales and forms a first set of terry loops in the sinker wales in both the heel 11, toe 12, and ball 15 but is knit in plated relationship with the body yarn B in the sinker wales in the instep 14. Thus, the first terry yarn T-1 does not form terry loops in the instep 14, as illustrated between the needle wales W-1 and W-2 of FIG. 7 and between the needle wales W-1 and W-2 of FIG. 9.

Figure 7:
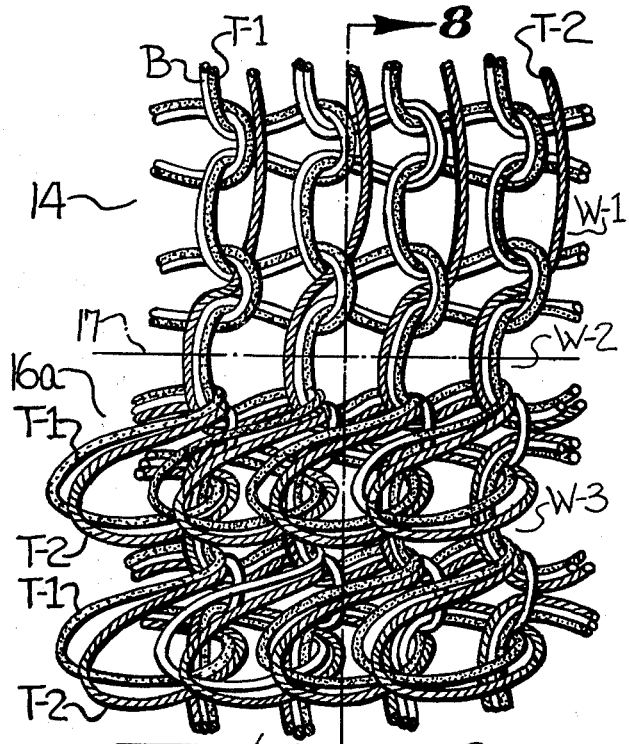
FIG. 7 is a greatly enlarged elevational view of a small area of the knit fabric, being taken substantially in the dotted rectangle area 7 in FIG. 4, and illustrating the manner in which the first and second terry yarns form first and second sets of terry loops and are incorporated with the body yarn in the inner arch portion.
Figure 8:
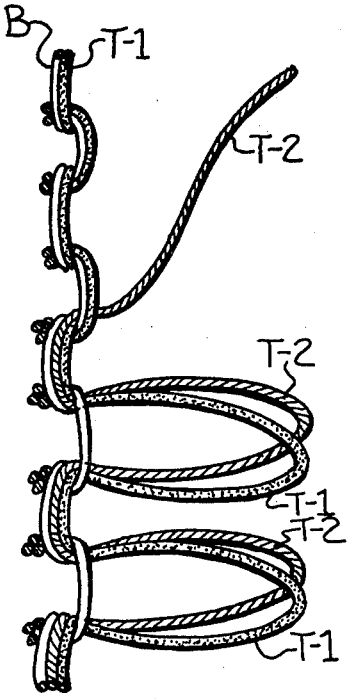
FIG. 8 is a vertical sectional view taken along the line 8—8 in FIG. 7 and illustrating the more dense or greater number of terry loops in the inner portion of the arch area.
Figure 9:
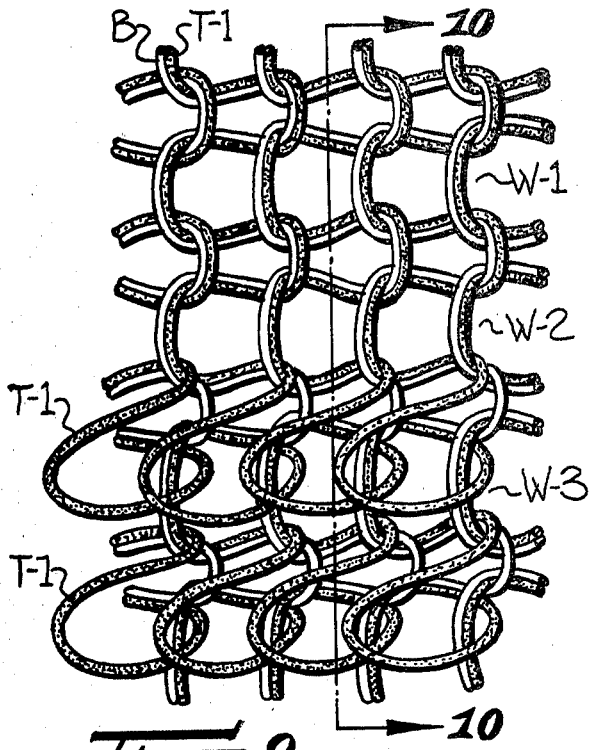
FIG. 9 is a view similar to FIG. 7 but being taken in the area of the dotted rectangle 9 in FIG. 4 and illustrating the manner in which the single terry yarn forms a single set of terry loops in the ball area and is knit in plated relationship with the body yarn in the upper instep so that the upper instep portion of the sock is devoid of terry loops.
Figure 10:
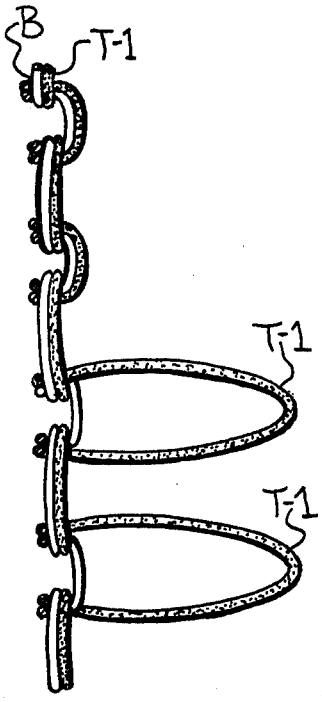
FIG. 10 is a vertical sectional view taken along the line 10—10 in FIG. 9.

A second terry yarn, indicated at T-2 and striped for identification in FIGS. 7 and 8, is knit with the body yarn B and forms a second set of terry loops in the inner portion 16*a* of the arch 16, as illustrated below the dash-dot line 17 in FIG. 7. The second terry yarn T-2 is fed to the needles through what is known as a "chopping" yarn feed finger and is fed to and removed and cut adjacent opposite sides of the inner portion 16*a* of the arch 16, as illustrated in FIG. 8, so that the second terry yarn T-2 is not incorporated in the corresponding portion of the instep 14 and in the outer portion 16*b* of the arch 16.

In the knit fabric shown in FIGS. 7–10, the body yarn B, the first terry yarn T-1 and the second terry yarn T-2 are illustrated as being of substantially the same size and the stitch structure is shown very open, for purposes of clarity. However, in the actual sock, the knit stitch loops contract and are very small and the terry yarns T-1 and T-2 are usually larger and bulkier than the body yarn B. The loose loops of the terry loops are free to relax so that the bulk in the yarn is developed, during finishing, and the terry loops are thicker, more dense and more crowded together than illustrated in FIGS. 7–10. Even when a single set of terry loops is formed of the terry yarn T-1 in certain areas of the sock, such as in the heel 11, the outer portion 16*b* of the arch 16, the ball 15 (FIGS. 9 and 10), and the toe 12, a fairly dense compact cushion is formed. When the second set of terry loops is added, such as in the inner portion 16*a* of the arch 16 (FIGS. 7 and 8), the terry loops are packed closer together and are more concentrated to form a much denser concentration of terry loops in the arch support cushion pad C.

There are twice the number of terry loops formed in a given area of the inner portion 16*a* of the arch 16 as the number of terry loops formed in the outer portion 16*b* of the arch 16 so that the terry loop density in the inner portion 16*a* of the arch area 16 is greater than the terry loop density in the outer portion 16*b* of the arch 16, the heel 11, the ball 15, and the toe 12. When an attempt is made to compress the terry loops in the inner portion 16*a* of the arch 16, which includes two sets of terry loops, there are so many terry loops packed into such a small area that they cannot lean over and flatten as easily as those areas where only a single set of terry loops is formed.

Thus, the first and second sets of terry loops in the inner portion 16*a* of the arch 16 form an arch support cushion pad C of greater terry loop density to provide a greater amount of cushioning or padding in the inner portion of the arch of the foot of the wearer. The extra set of terry loops in the inner portion 16*a* of the arch 16 thus provides a thicker or more dense cushioned arch support pad or cushion C in the inner portion of the arch of the wearer, as schematically illustrated at 16*a* in FIG. 5. The other areas of lesser terry loop density in the heel 11, ball 15, and toe 12 are also schematically illustrated in FIG. 5.

Figure 5:
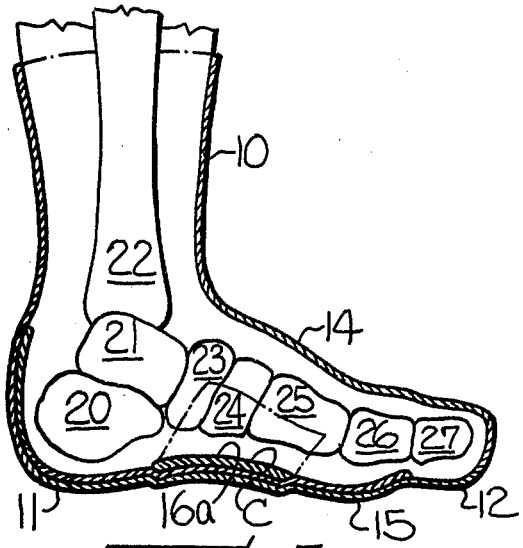
FIG. 5 is a longitudinal sectional view of the sock on the foot, showing the bones in the foot and schematically illustrating the areas of additional or more dense terry loop cushioning or padding provided in the inner portion of the arch area of the sock.

The more dense terry loops forming the arch support pad C (FIG. 5) against the inner portion of the arch of the foot are thus located where the greatest protection is needed for the arch when jogging and running. As shown in FIG. 5, the heel or calcaneus bone 20 is positioned beneath the talus bone 21 and at the lower end of the tibia 22. The other main bones in the foot include the navicular 23, the cuneiform 24, the metatarsals 25, the phalanges 26, and the toe bones 27.

As illustrated in FIG. 5, the more dense terry loops forming the arch support pad C are positioned against the inner portion of the arch of the foot and beneath the arch bones, adjacent opposite sides of the cuneiform 24. When the foot impacts against the surface, the cartilages joining the bones in the arch, particularly the talus 21, the navicular 23, the cuneiform 24, and the upper ends of the metatarsals 25 provide elasticity and the arch tends to flatten so that the inner portion of the arch of the foot receives a major portion of the shock of the impact, when the shoe is provided with the proper type of arch support, and if the same type of terry loop cushioning were provided throughout both the inner and outer portions of the arch of the foot of the wearer. Since the inner portion 16*a* of the arch area 16 of the sock of the present invention is provided with relatively greater terry loop density and is knit with a greater amount of yarn than the amount of yarn in the adjacent outer portion 16*b*, an arch support pad C is provided against the inner portions of the arches of each foot of the wearer. The terry yarns T-1 and T-2 and the body yarn B may be of the same or different colors and either or both of the terry yarns may be plated with the body yarn so that they appear on the outer surface of the sock.

DESCRIPTION OF THE EMBODIMENT ILLUSTRATED IN FIGS. 11–13

Figure 11:
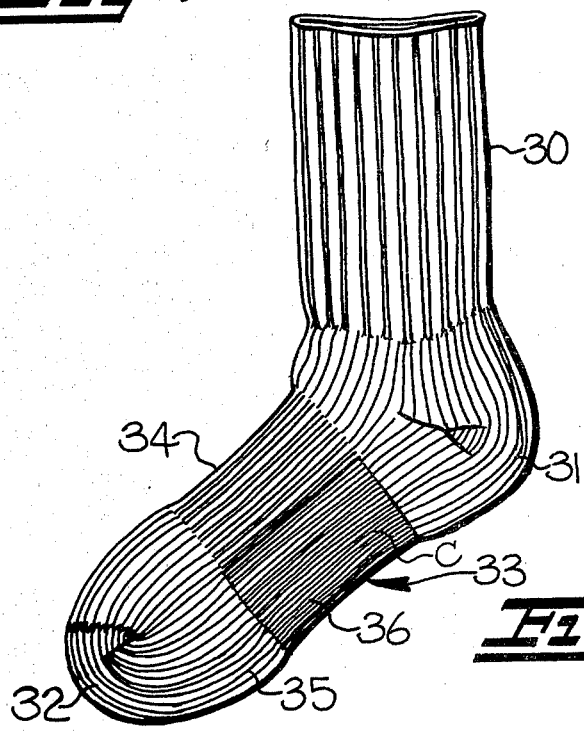
FIG. 11 is a side elevational view of the "right" sock of another embodiment of the socks of the present invention.
Figure 12:
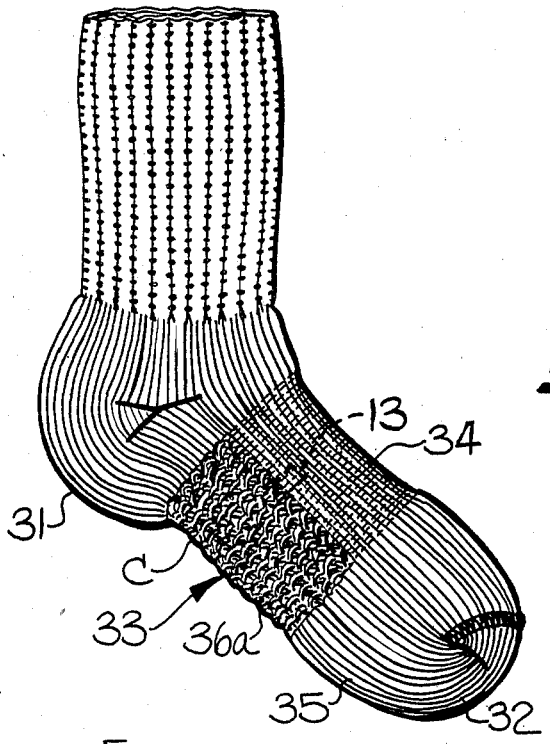
FIG. 12 is a view similar to FIG. 11 but illustrating the sock in everted condition with the terry loops in the cushioned areas on the inner portion of the arch area positioned on the outer surface thereof.
Figure 13:
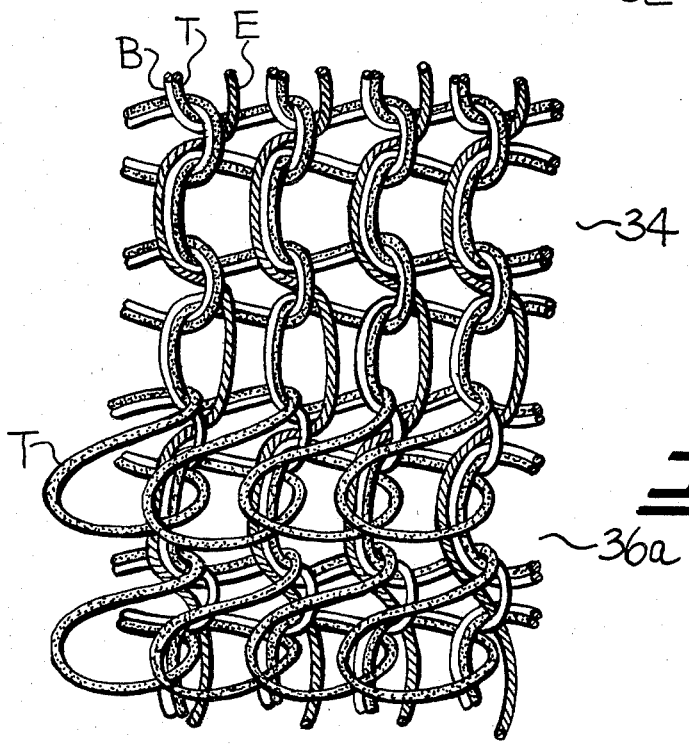
FIG. 13 is a greatly enlarged fragmentary elevational view taken substantially in the area of the dotted rectangle area 13 in FIG. 12 and illustrating the manner in which a single terry yarn forms a single set of terry loops in the inner portion of the arch area, and with an elastic yarn being inlaid in the arch and adjacent instep areas.

The "right" sock illustrated in FIGS. 11–13 is of the same general type as the socks of FIGS. 1–10 and includes a mock rib cuff 30. The foot of the sock includes a reciprocatorily knit heel pocket 31 and a reciprocatorily knit toe pocket 32. The foot also includes an integrally knit lower sole, broadly indicated at 33, which connects the heel pocket 31 and the toe pocket 32, and an upper instep 34. The sole 33 encompasses substantially one-half the lower circumference of the foot and the instep 34 encompasses substantially one-half the circumference of the upper portion of the foot. The sole 33 includes a ball area 35 positioned adjacent to the toe pocket 32 and extending to an integrally knit arch area 36.

The arch area 36 extends across the sole 33 and from one side to the other of the instep 34. The arch area 36 is divided along the middle wale of the sole to define an inner arch area 36*a*, which is provided with an arch support cushion pad C, and an outer arch area, not shown, but on the opposite side of the sock from the inner arch area 36*a*.

Like the socks illustrated in FIGS. 1–10, the sock illustrated in FIGS. 11–13 is knit throughout of a suitable body yarn B (FIG. 13) and a terry yarn T is knit with the body yarn and forms a set of terry loops extending throughout the inner arch area 36*a*. The terry yarn T is knit in plated relationship with the body yarn B and does not form terry loops in the instep 34 and the adjacent outer arch area of the arch 36. Although the body yarn B and the terry yarn T are knit together throughout the arch 36, terry loops T-1 are formed only in the inner arch area 36*a* so that a greater amount of yarn is knit in the inner arch portion 36*a* than in the outer arch portion. The terry yarn T is also knit in plated relationship with the body yarn B and no terry loops are formed in the heel pocket 31, the toe pocket 32, the instep 34, the ball area 35, and the outer arch area.

The terry loops in the inner arch area 36*a* thus form the arch support cushion pad C which is positioned against the inner portions of the arches of the feet of the wearer. It is preferred that an elastic yarn E (FIG. 13) be inlaid in the arch 36 and adjacent area of the instep 34. The elastic yarn E, striped for identification in FIG. 13, is inlaid in the usual manner and extends throughout the non-terry instep 34, the non-terry outer arch area, and the terry arch support cushion pad C. The elastic yarn E acts to draw the sock inwardly against the foot in both the instep and arch areas to aid in maintaining the arch support cushion pad C in the proper position against the inner portions of the arches of the wearer's feet.

DESCRIPTION OF THE EMBODIMENT ILLUSTRATED IN FIGS. 14 AND 15

Figure 14:
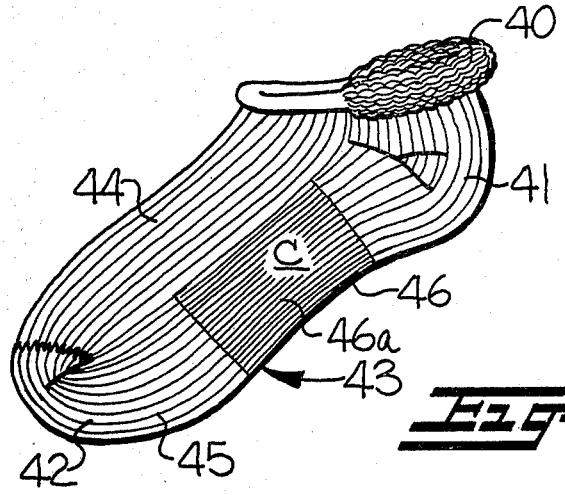
FIGS. 14 and 15 are elevational views of respective "right" and "left" socks illustrating the arch cushions of the present invention embodied in low-cut type socks.
Figure 15:
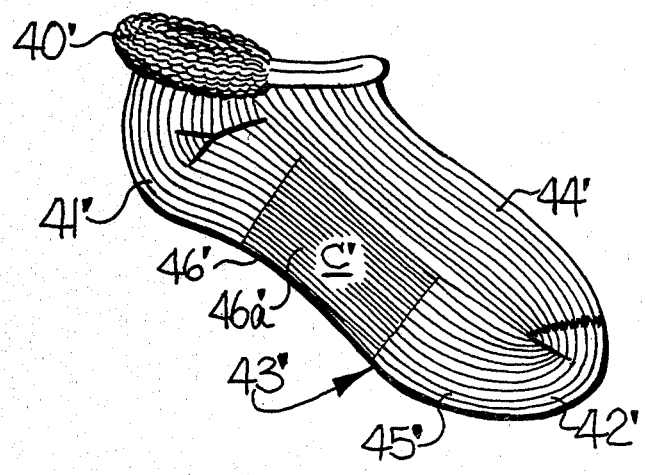

The "right" sock of FIG. 14 and the "left" sock of FIG. 15 are of the low-cut type and are knit in accordance with my prior U.S. Pat. No. 3,274,804 to provide respective upper foot receiving roll top openings 40, 40', heel pockets 41, 41' and toe pockets 42, 42'. The "right" sock of FIG. 14 will be described and the corresponding parts of the "left" sock of FIG. 15 will bear the same reference characters with the prime notation added. The sock includes a lower sole, broadly indicated at 43, which encompasses substantially one-half the lower circumference of the foot, and an upper instep 44 which encompasses substantially one-half the circumference of the upper portion of the foot.

The sole 43 includes a ball area 45 positioned adjacent to the toe pocket 42 and extending to an integrally knit arch area 46. The arch area 46 extends across the sole 43 and from one side to the other of the instep 44. The arch area 46 is divided along the middle wale of the sole to define an inner arch area 46*a*, provided with an arch support cushion C, and an outer arch area, not shown, but on the opposite side of the sock from the inner arch area 46*a*.

Figure 4:
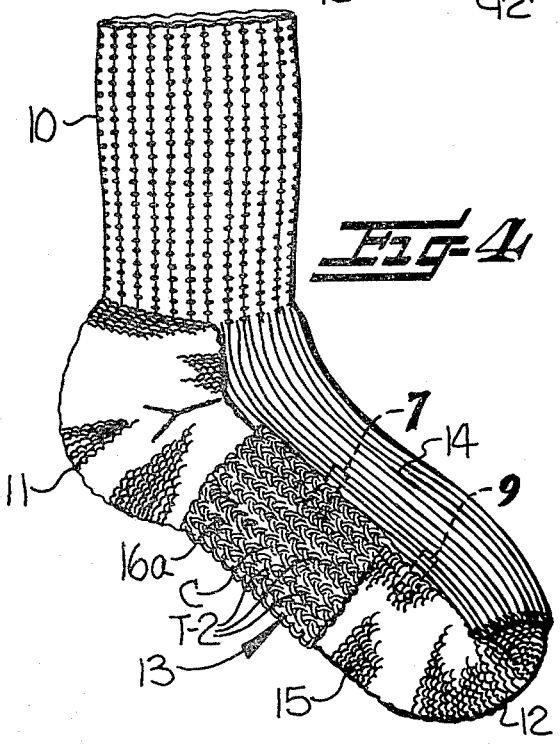
FIG. 4 is a view similar to FIG. 1 but illustrating the sock in everted condition with the terry loop areas facing outwardly.

The inner surfaces of the feet of the socks of FIGS. 14 and 15 may be provided with terry loops of the type shown in FIG. 4 or of the type shown in FIG. 12. In either event, the support cushion C is integrally knit with a greater amount of yarn in the inner arch portion than the amount of yarn knit in the outer arch portion, or the support cushion C has a greater terry loop density than the terry loop density of the outer arch portion.

While three particular embodiments of socks have been illustrated and described, it is to be understood that these particular illustrated embodiments may be varied, depending upon the particular need. For example, the inner arch area 36*a* of the sock of FIG. 12 may include a second terry yarn to provide additional cushioning. Also, elastic yarn may be inlaid in the arch area 16 and the instep 14 of the socks of FIGS. 1–6 to aid in maintaining the arch support cushion pad in the proper position against the inner portions of the arches of the feet of the wearer.

The inner arch support cushion of the present invention is preferably formed by terry loops, as illustrated and described. However, it is to be understood that the inner arch support cushion can be formed by incorporating additional amounts of yarn by other means, such as by plating, wrapping, tucking or other known knitting techniques. In any event, the integrally knit support cushion in the inner arch portion must include a sufficiently greater amount of yarn than the amount of yarn knit in the outer arch portion in order to provide increased thickness and a sufficient amount of support and cushioning to the inner arch area which is adapted to underlie the inner arch of the wearer's foot. It has been found that the total weight of the yarns in the inner arch portion should be at least 15 percent greater than the total weight of the yarns in the outer arch portion.

In the drawings and specification there have been set forth preferred embodiments of the invention, and although specific terms are employed, they are used in a generic and descriptive sense only and not for purposes of limitation, the scope of the invention being defined in the claims.

That which is claimed is:

1. A knit athletic sock for providing additional cushioning in the inner arch area of a wearer's foot and particularly adapted for wear with athletic shoes having arch supports which fail to provide sufficient support and cushioning to prevent discomfort to the wearer's arch during participation in vigorous athletic activities such as jogging and running, said sock comprisinng a lower sole including an arch area in the medial portion of said sole, said arch area including inner and outer arch portions positioned on opposite sides of said sole and extending coursewise from substantially the middle wale of said sole, said inner arch portion having an integrally knit support cushion formed by a sufficiently greater amount of yarn being knit in the inner arch portion than the amount of yarn being knit in said outer arch portion to provide increased thickness in the inner arch portion which is adapted to underlie the inner arch of the wearer's foot for enhancing the support and cushioning on the inner arch area of the wearer's foot and thereby reducing the shock normally imparted to the inner arch of the wearer's foot so that normal articulation of the bones in the foot takes place during participation in vigorous athletic activities.

2. A sock according to claim 1 wherein the greater amount of yarn in said inner arch portion is in the form of terry loops.

3. A sock according to claim 2 wherein said outer arch portion is devoid of terry loops.

4. A sock according to claim 2 wherein said inner arch portion includes first and second sets of terry loops.

5. A knit athletic sock for providing additional cushioning in the inner arch area of a wearer's foot and particularly adapted for wear with athletic shoes having arch supports which fail to provide sufficient support and cushioning to prevent discomfort to the wearer's arch during participation in vigorous athletic activities such as jogging and running, said sock comprising a lower sole knit of body yarn and including an arch area in the medial portion of said sole, said arch area including inner and outer arch portions positioned on opposite sides of said sole and extending coursewise from substantially the middle wale of said sole, said arch area being knit of said body yarn and a first terry yarn forming a first set of terry loops in said inner and outer arch portions, said inner arch portion having an integrally knit support cushion adapted to underlie the inner arch of the wearer's foot and being knit with a second terry yarn knit with said body yarn and said first terry yarn to form a second set of terry loops in said inner arch portion, said support cushion including a greater terry loop density than the terry loop density in said outer arch portion for enhancing the support and cushioning on the inner arch area of the wearer's foot and thereby reducing the shock normally imparted to the inner arch of the wearer's foot so that normal articulation of the bones in the foot takes place during participation in vigorous athletic activities.

6. A sock according to claim 5 wherein said second terry yarn in said inner arch portion is cut and forms free ends at opposite sides of said inner arch portion.

7. A knit athletic sock for providing additional cushioning in the inner arch area of a wearer's foot and particularly adapted for wear with athletic shoes having arch supports which fail to provide sufficient support and cushioning to prevent discomfort to the wearer's arch during participation in vigorous athletic activities such as jogging and running, said sock comprising a lower sole knit of body yarn and including an arch area in the medial portion of said sole, said arch area including inner and outer arch portions positioned on opposite sides of said sole and extending coursewise from substantially the middle wale of said sole, said arch area being knit of said body yarn in said inner and outer arch portions, said inner arch portion having an integrally knit support cushion adapted to underlie the inner arch of the wearer's foot and being knit with terry yarn knit with said body yarn and forming terry loops in said inner arch portion, said terry yarn being knit in plated relationship with said body yarn in said outer arch portion without forming terry loops, said support cushion with said terry loops enhancing the support and cushioning on the inner arch area of the wearer's foot and thereby reducing the shock normally imparted to the inner arch of the wearer's foot so that normal articulation of the bones in the foot takes place during participation in vigorous athletic activities.

* * * * *